US006053549A

United States Patent [19]

Wilkinson

[11] Patent Number: 6,053,549

[45] Date of Patent: Apr. 25, 2000

[54] TORPEDO NOSE LIFT DEVICE

[75] Inventor: William S. Wilkinson, North Dartmouth, Mass.

[73] Assignee: The United States of America as represented by the Secretary of the Navy, Washington, D.C.

[21] Appl. No.: 09/173,613

[22] Filed: Oct. 13, 1998

[51] Int. Cl.[7] ..... B66C 1/16; B66C 13/08

[52] U.S. Cl. ..... 294/81.3; 294/67.5; 294/74; 294/81.55

[58] Field of Search ..... 294/67.1, 67.21, 294/67.3, 67.4, 67.41, 67.5, 74, 75, 81.2, 81.3, 81.4, 81.5, 81.55, 82.12, 82.26, 149–157; 248/58–60, 62, 74.1, 74.3

[56] References Cited

U.S. PATENT DOCUMENTS

| | | | |
|---|---|---|---|
| 2,452,392 | 10/1948 | Philbin | 294/81.55 |
| 3,596,969 | 8/1971 | La Rosa | 294/81.3 |
| 3,744,837 | 7/1973 | Foster | 294/74 |
| 4,066,287 | 1/1978 | Rowley | 294/67.41 X |
| 4,329,109 | 5/1982 | Bleyker | 294/81.3 X |
| 4,930,732 | 6/1990 | Hardtke | 294/74 X |

*Primary Examiner*—Johnny D. Cherry
*Attorney, Agent, or Firm*—Michael J. McGowan; Robert W. Gauthier; Prithvi C. Lall

[57] ABSTRACT

In accordance with the present invention, a single point lifting device is provided for a torpedo nose section. The device has two parallel plates, spaced slightly apart with edges placed longitudinally on the nose section. The edges are shaped to fit the nose section contour. A T-shaped member is inverted and fixed between the two plates, each edge of the horizontal leg suitably attached to one of the plates to form an H-shaped section with the vertical leg of the T extending upwards. Two cinch straps extend around the nose section and lifting device to securely hold the plates against the nose section. A metal strap extends between the cinch straps on the opposite side of the nose section from the plates to prevent the cinch straps from slipping off the contoured nose section. To accommodate the varying centers of gravity for different nose component configurations, the lifting hook placement along the T-section can be varied or the T-section can be moved fore and aft between the parallel plates.

13 Claims, 2 Drawing Sheets

TORPEDO NOSE LIFT DEVICE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to lifting devices, and more particularly to a device for lifting a torpedo nose in a horizontal orientation.

(2) Description of the Prior Art

It is often necessary in testing torpedoes to remove the nose section of the torpedo from the main body section. Removal and reconnection of the nose section requires alignment of the nose and body section. The torpedo is typically horizontally supported on a dolly during these operations. The main body section is cylindrical and can be readily supported in a horizontal fashion by the dolly. The nose section is hydrodynamically shaped (generally conical), requiring a specialized nose tilt dolly assembly to maintain the alignment of the nose section with the main body section. The torpedo is fully supported on a dolly assembly. When the nose section is unconnected from the main body, the nose tilt dolly is backed away from the main dolly to separate the nose section from the main body. The process is reversed to reassemble the torpedo. The nose tilt dolly assembly is very large and cannot be easily used in areas not specifically designed for torpedo refit, e.g., aboard a research vessel. A single point lifting device is needed in such areas where space is restricted. However, various configurations of components within the nose section may be tested. Each configuration may have a unique center of gravity, making it more difficult to maintain the nose section horizontally with a single point lift.

A number of hoist slings have been developed to support various shaped objects. U.S. Pat. No. 4,930,732 to Hardtke recites a yoke clip for lifting piping. The yoke pipe clip comprises a pair of generally parallel plates in a side-by-side spaced relationship which are placed transversely over the pipe, the plates having a lower edge contoured to fit the upper surface of the pipe. A pair of separator plates disposed one at each opposite end of the parallel plates maintains the separation between the parallel plates. A yoke is placed beneath the pipe, each of its free ends extending upward through one of the separator plates. A bolt is threaded onto the yoke ends and tightened against the separator plates, bringing the yoke and parallel plates to bear against opposite sides of the pipe. A suspension bracket is positioned between and interlocked with the parallel plates, and the pipe is lifted by this bracket. If the conical nose section were lifted with this yoke pipe clip, it would be canted from the necessary horizontal position.

U.S. Pat. No. 4,844,396 to Norton shows another mounting for attaching a sensor to a pipe, but which could be adapted for supporting a section of pipe. A bracket with flexible legs is placed over the pipe such that the legs extend slightly around the pipe. The bracket has vertical clips extending away from the top of the pipe. A chain is attached to and extends from one vertical clip, around the bottom of the pipe and is attached to the other vertical clip. Tightening the chain brings the bracket legs in firm contact with the pipe. The pipe can be lifted from the bracket, or a sensor can be mounted within the bracket such that the sensor is brought into contact with the pipe when the chain is tightened. As with the Hardtke device, no provision is made for maintaining a horizontal orientation when lifting a conical shape. U.S. Pat. No. 3,840,262 to Foster et al. provides a simple sling arrangement for lifting a pipe which also cannot easily be adapted to lift a conical section in a horizontal manner.

SUMMARY OF THE INVENTION

Accordingly, it is an object of the present invention to provide a lifting device which maintains the nose section of a torpedo in a horizontal position when separated from the main body of the torpedo.

Another object of the present invention is to provide a torpedo nose section lifting device which can be used in areas having limited space.

Still another object of the present invention is to provide a single point lifting device for a torpedo nose section.

Other objects and advantages of the present invention will become more obvious hereinafter in the specification and drawings.

In accordance with the present invention, a single point lifting device is provided for a torpedo nose section. The device has two parallel plates, spaced slightly apart and placed longitudinally on the nose section. The bottom edge of the plates is shaped to fit the contour of the nose section. A T-shaped member of approximately the same length as the parallel plates is inverted and fixed between the two plates. Each edge of the horizontal leg of the T is suitably attached to one of the plates, as by welding or the like, to form an H-shaped section with the vertical leg of the T extending upwards beyond the top edges of the plates. A cinch strap extends around the nose section and lifting device at the forward and rear ends of the plates to securely hold the plates against the nose section. A metal strap extending between the cinch straps on the opposite side of the nose section from the plates prevents the cinch straps from slipping off the contoured nose section. A lifting hook is placed into the vertical leg of the T-section to hoist the nose section away from the main body. To accommodate the varying centers of gravity for different nose component configurations, the lifting hook placement along the T-section can be varied. In a preferred embodiment, the T-section can be moved fore and aft between the parallel plates by providing a series of bolt holes along the edges of the horizontal legs and bolting through the parallel plates to attach the T-section to the plates. In another embodiment a horizontal plate is first attached between the parallel plates and the T-section is adjustably mounted to the horizontal plate by means of bolting the T-section to the horizontal plate through slotted holes in the T-section. Additionally, an elastomeric covering can be provided over the edges of the parallel plates in contact with the nose section to prevent damage to the nose section when the plates are tightened against the nose section. By providing shaped plates longitudinally along the nose section and allowing hook placement at the proper center of gravity for the nose section, the section can be raised in a horizontal orientation. The cinch straps provide an easy method of attaching the device to the nose section and the metal strap prevents them from slipping off the nose section. The device is very compact, easily transported aboard a research vessel and can be used with any one of many types of lift hooks commonly available aboard such a vessel.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 2:
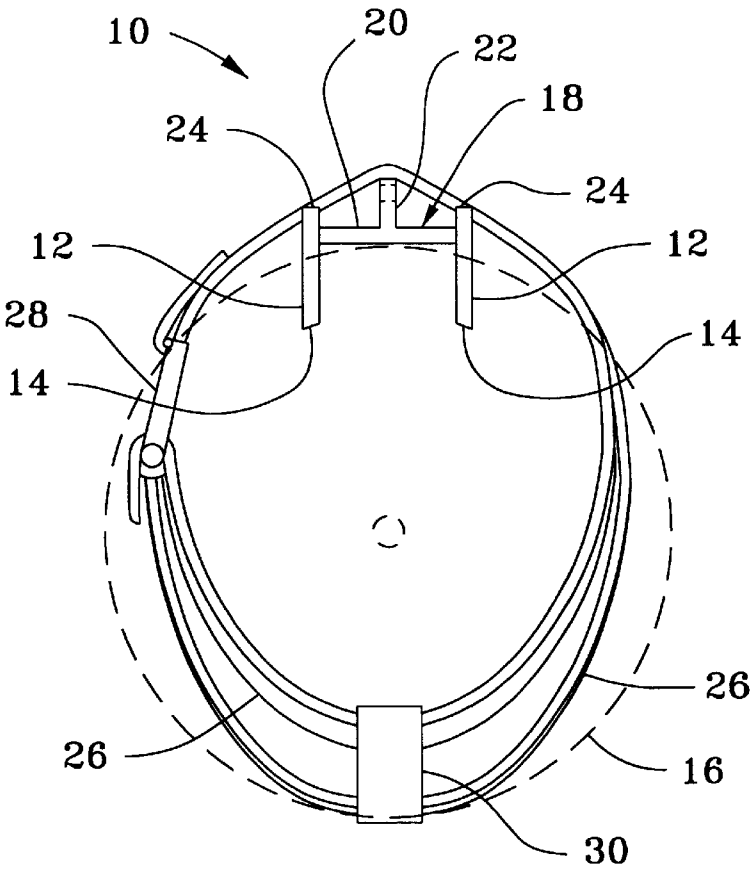
FIG. 2 is an end view of the lifting device.
Figure 1:
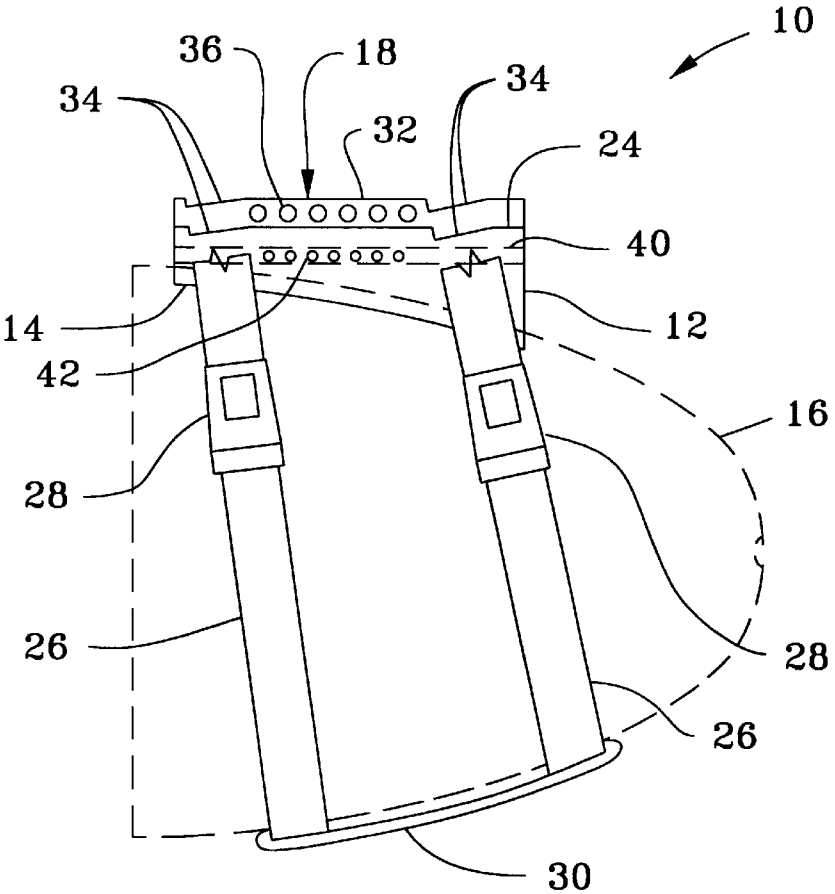
FIG. 1 is a side view of the lifting device.

Referring now to FIG. 1 and FIG. 2, there are shown side and end views, respectively, of the nose lifting device 10. Two parallel plates 12 have contoured bottom edges 14 shaped to match the contour of a torpedo nose section 16, shown in phantom. Inverted T-section 18 is fixed between upright parallel plates 12, having its horizontal leg 20 forming an H-section with the parallel plates 12 and also serving as a spacer to maintain the separation between plates 12. Vertical leg 22 extends upwards so as to be above the top edge 24 of plates 12. Two cinch straps 26 (shown partially removed in FIG. 1 for clarity) wrap around device 10 and nose section 16. Cinch straps 26 are tightened using any well known means common for such straps, such as ratcheting mechanisms 28, holding device 10 tight against nose section 16. A metal holding strap 30 attaches between cinch straps 26 on the opposite side of nose section 16 from plates 12, preventing cinch straps 26 from slipping off of the contoured shape of nose section 16. Additionally, in the preferred embodiment, top edges 24 of plates 12 and top edge 32 of vertical leg 22 of T-section 18 have one or more notches 34 for placement of cinch straps 26. In this embodiment, cinch straps 26 are better able to follow the contour of nose section 16 to provide a tighter grip about the nose section 16. Vertical leg 22 has a plurality of apertures 36 for placement of a lifting hook (not shown). By careful selection of one of the apertures 36, a lifting hook can be placed directly over the center of gravity of nose section 16 and lifting device 10.

Figure 4:
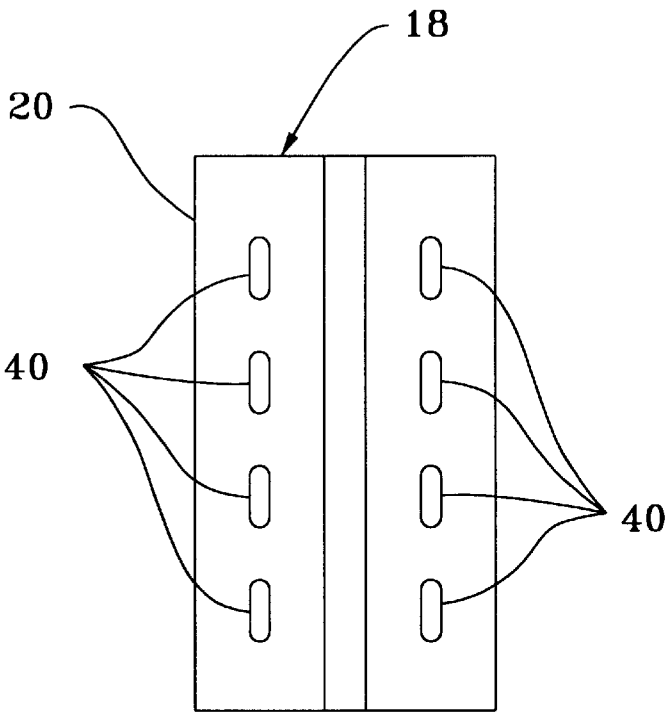
FIG. 4 is a top view of the T-section component of the second embodiment of the lifting device.
Figure 3:
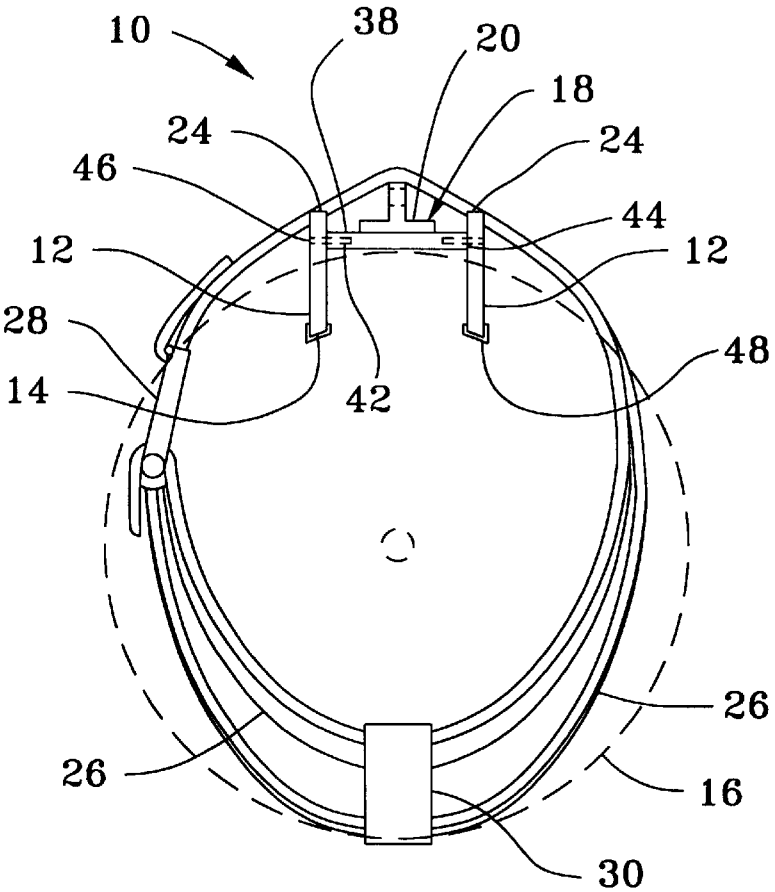
FIG. 3 is an end view of a second embodiment of the lifting device.

In another embodiment, shown in FIG. 3 and FIG. 4, a separate horizontal plate 38 is fixed between plates 12, with T-section 18 attached to horizontal plate 38. A plurality of slots 40 (shown in FIG. 4) are provided in horizontal leg 20 and T-section 18 is bolted to horizontal plate 38. The slots 40 allow for longitudinal adjustment of T-section 18 along nose section 16, again allowing a lifting hook to be placed directly over the center of gravity of nose section 16 and lifting device 10. In this embodiment, horizontal plate 38 has a plurality of threaded bores 42 along each edge 44. Corresponding apertures 46 in plates 12 allow horizontal plate 38 to be bolted between plates 12 at varying locations. In the embodiment shown in FIGS. 3 and 4, edges 14 of parallel plates 12 are shown with a covering 48 to prevent damage to nose section 16 when cinch straps 26 are tightened.

The invention thus described provides a simple, easily transportable device for handling a torpedo nose section in a horizontal orientation. The contoured edges of the plates provide positive contact against the nose section, while the cinch straps are a simple method of attaching the plates to the nose section. The metal holding strap and the notches in the parallel plates allow the cinch straps to wrap tightly about the nose section without slippage. The plurality of apertures in the T-section or in the connection of the T-section to the parallel plates allow for varying the placement of a lifting hook. In this way, the lifting hook can be positioned directly over the center of gravity of the nose section and lifting device, ensuring that the nose section remains horizontal when lifted.

Although the present invention has been described relative to a specific embodiment thereof, it is not so limited. For example, the edges of the parallel plates can be shaped, and the straps adjusted, to fit other contours besides that of a torpedo nose section. Also, the holding strap need not be metal, but may be made of the same material as the cinch straps. The holding strap may also be attached between the cinch straps once they are placed over the nose section, or may be attached directly to the cinch straps. The cinch straps may be any type of strap suitable for surrounding the nose section and capable of being tightened, such as a chain, fabric, or polymer type strap. The cinch straps may either be separate from the plates and T-section, or can have one end attached to the plates or T-section. Additionally, the material used along the edges of the parallel plates in contact with the nose section can be any suitable elastomeric material which will maintain a firm grip between the plates and the nose section. In one use of the lifting device, a longitudinally cut length of polymer hose provided effective protection and was easily installed on the edges.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A device for lifting an object so as to maintain an axis of the object in a horizontal orientation, the device comprising:

at least two parallel plates spaced a distance apart and having corresponding edges shaped to fit a contour of the object;

a spacer plate fixed between the at least two parallel plates and maintaining the spacing of the parallel plates;

at least two gripping straps in a spaced relationship, each gripping strap surrounding the object and the plates, the gripping straps being tightened to secure the device to the object in an orientation having the parallel plates generally perpendicular to the object and aligned with the axis, the edges mating with the contour of the object; and at least one lift hook aperture aligned with a center of gravity of the object.

2. The device of claim 1 further comprising a vertical plate fixed generally perpendicular to the spacer plate, generally aligned with the parallel plates and extending away from the object, the at least one aperture being located within the vertical plate.

3. The device of claim 2 wherein the placement of the spacer plate between the parallel plates is adjustable in the direction of the axis, the adjustment allowing alignment of the at least one lift hook aperture with the center of gravity.

4. The device of claim 3 further comprising a holding strap connecting the at least two gripping straps at a location near the contour of the object opposite that of the parallel plates.

5. The device of claim 1 wherein edges of the parallel plates opposite the corresponding edges are notched to accommodate the gripping straps and to further align the gripping straps with the contour of the object.

6. The device of claim 1 further comprising a holding strap connecting the at least two gripping straps at a location near the contour of the object opposite that of the parallel plates.

7. The device of claim 6 further comprising a holding strap connecting the at least two gripping straps at a location near the contour of the object opposite that of the parallel plates.

8. The device of claim 1 wherein the placement of the spacer plate between the parallel plates is adjustable in the direction of the axis, the adjustment allowing alignment of the at least one lift hook aperture with the center of gravity.

9. The device of claim 8 wherein each edge of the spacer plate in contact with the parallel plates contains a plurality of threaded bores and a corresponding plurality of bores is provided in the parallel plates, the spacer plate being fixed to the parallel plates by a plurality of bolts passing through the corresponding bores in the parallel plates and threading into the threaded bores of the spacer plate.

10. A device for lifting an object so as to maintain an axis of the object in a horizontal orientation, the device comprising:

at least two parallel plates spaced a distance apart and having corresponding edges shaped to fit a contour of the object nearest the device and further having at least one notch along an edge opposite the shaped edge, each notch having a base generally parallel with a contour of the object opposite the device;

a spacer plate fixed between the at least two parallel plates and maintaining the spacing of the parallel plates;

at least two gripping straps in a spaced relationship, one of the gripping straps fitting within the at least one notch and surrounding the object and the plates, the gripping straps being tightened to secure the device to the object in an orientation having the parallel plates generally perpendicular to the object and aligned with the axis, the edges mating with the contour of the object;

a holding strap connecting the at least two gripping straps at a location near the contour of the object opposite that of the parallel plates; and at least one lift hook aperture aligned with a center of gravity of the object.

11. The device of claim 10 further comprising a vertical plate adjustably connected generally perpendicular to the spacer plate, generally aligned with the parallel plates and extending away from the object, the at least one aperture being located within the vertical plate, the at least one aperture being aligned with the center of gravity by adjustment of the connection between the vertical plate and the spacer plate.

12. The device of claim 10 further comprising an inverted t-section having a horizontal leg adjustably connected to and generally parallel to the spacer plate and having a vertical leg generally perpendicular to the spacer plate, the vertical leg generally aligned with the parallel plates and extending away from the object, the at least one aperture being located within the vertical leg.

13. The device of claim 12 wherein the at least one aperture is aligned with the center of gravity by adjustment of the connection between the t-section and the spacer plate, the connection comprising a plurality of slotted apertures in the horizontal leg, the slotted apertures being generally aligned with the axis of the object and accommodating a plurality of bolts attaching the t-section to the spacer plate.

* * * * *